US009397444B1

(12) United States Patent
Wu

(10) Patent No.: US 9,397,444 B1
(45) Date of Patent: Jul. 19, 2016

(54) TERMINAL BLOCK WIRING DEVICE

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/726,831

(22) Filed: Jun. 1, 2015

(51) Int. Cl.
*H01R 13/00* (2006.01)
*H01R 13/631* (2006.01)

(52) U.S. Cl.
CPC ..... *H01R 13/631* (2013.01)

(58) Field of Classification Search
CPC .. H01R 13/631; H01R 12/714; H01R 12/592; H01R 12/721; H01R 12/88; H01R 12/79
USPC ..... 439/483
See application file for complete search history.

(56) References Cited

U.S. PATENT DOCUMENTS 5,580,272 A * 12/1996 Yamaguchi ..... H01R 12/79 439/260
6,250,966 B1 * 6/2001 Hashimoto ..... H01R 12/774 439/495
7,303,429 B2 * 12/2007 Kim ..... H01R 12/88 439/425
8,241,045 B2 * 8/2012 Reed ..... H01R 9/038 439/626
8,550,854 B2 * 10/2013 Okano ..... H01R 12/721 439/631
8,613,631 B2 * 12/2013 Hemmi ..... H01R 12/88 439/260
8,936,487 B2 * 1/2015 Takane ..... H01R 12/79 439/626
9,219,319 B2 * 12/2015 Chen ..... H01R 12/592
9,270,044 B2 * 2/2016 Hara ..... H01R 12/714

* cited by examiner

*Primary Examiner* — Jean F Duverne
(74) *Attorney, Agent, or Firm* — Chun-Ming Shih; HDLS IPR Services

(57) ABSTRACT

A terminal block wiring device includes a terminal block and a wiring jig (20, 20*a*). The wiring jig includes a handgrip (21, 21*a*) and a hook arm (22, 22*a*), the handgrip (21, 21*a*) is formed with a first positioning protrusion (211, 211*a*), the hook arm (22, 22*a*) is formed with a second positioning protrusion (221, 221*a*), the wiring jig (20, 20*a*) is able to be positioned on a terminal block (10, 10*a*) through the first positioning protrusion (211, 211*a*) and the second positioning protrusion (221, 221*a*); when an external force is applied and the first positioning protrusion (211, 211*a*) is served as a pivot, a cable (2) is enabled to be rapidly inserted and electrically connected to an electric conductive terminal (12), so effects of fast, convenience and labor saving of the wiring operation can be achieved, and the wiring efficiency can also be increased.

14 Claims, 8 Drawing Sheets

TERMINAL BLOCK WIRING DEVICE

BACKGROUND OF THE INVENTION

1. Field of the Invention

The present invention relates to a jig, especially to a terminal block wiring device.

2. Description of Related Art

A terminal block is a composed of an insulation seat and electric conductive components so as to form an electrically conducting device used as a platform allowing a plurality of wires to be electrically connected. The terminal block is widely applied in various fields, such as being applied in an electronic device (for example an air conditioner, a refrigerator, a washing machine or an oven), or a mechanical equipment (for example an industrial computer, an uninterruptible power system or a power supply), or an engineering control equipment (for example an electromechanical system, a refrigerating air conditioner or a programmable controller) or other devices.

In a conventional terminal block, at least one elastic sheet is installed for fastening at least one cable, and the conventional wiring means is to firstly fasten the terminal block then a screwdriver is utilized to press the elastic sheet for allowing the cable to be inserted into the terminal block for the purpose of electric conduction, then the screwdriver is removed for enabling the elastic sheet to press the cable so as to be positioned in the terminal block. During the wiring operation for the terminal block, a jig and the screwdriver are required, so the assembly is relatively inconvenient; moreover, if the screwdriver is not properly operated, the terminal block may be damaged. As such, the above mentioned shortages shall be improved.

Accordingly, the applicant of the present invention has devoted himself for improving the mentioned disadvantages.

SUMMARY OF THE INVENTION

The present invention is to provide a terminal block wiring device, so a wiring operation is provided with effects of fast, convenience and labor saving, and an advantage of allowing the wiring efficiency to be increased is also provided.

Accordingly, the present invention provides a terminal block wiring device, which is capable of facilitating a cable to be electrically connected and includes a terminal block and a wiring jig. The terminal block includes an insulation seat and an electric conductive terminal, a positioning elastic sheet and a pull member disposed in the insulation seat, the outer side of the insulation seat is formed with a positioning recess, the positioning elastic sheet is formed with a fasten end connected to the insulation seat and a free end extended above the electric conductive terminal, one end of the pull member is formed with an insertion slot exposed outside the insulation seat, and the other end thereof is abutted against the free end of the positioning elastic sheet; and the wiring jig includes a handgrip and a hook arm extended from the handgrip, one side of the handgrip is formed with a first positioning protrusion, and one distal end of the hook arm is formed with a second positioning protrusion, the wiring jig is able to be hanged on the terminal block through the first positioning protrusion being positioned in the positioning recess and the second positioning protrusion being inserted in the insertion slot; wherein, when an external force is applied to the handgrip and the first positioning protrusion is served as a pivot, the hook arm is able to drive the pull member to press the positioning elastic sheet, the free end is pressed by the pull member for being moved away from the electric conductive terminal, a cable is inserted in the insulation seat and electrically connected to the electric conductive terminal, and when the external force is released, the positioning elastic sheet is served to elastically press the cable for enabling the cable to be combined with and positioned in the insulation seat.

Accordingly, the present invention provides a terminal block wiring device, which is capable of facilitating a cable to be inserted in the terminal block, the terminal bock includes a positioning elastic sheet, an electric conductive terminal and a pull member, and the wiring jig includes a handgrip and a hook arm, one side of the handgrip is formed with a first positioning protrusion capable of being positioned on an outer surface of the terminal block; the hook arm is extended from the handgrip, and one distal end of the hook arm is formed with a second positioning protrusion capable of being inserted in the pull member; wherein, the wiring jig is hanged on the terminal block, an external force is applied to the handgrip and the first positioning protrusion is served as a pivot, so the hook arm is able to drive the pull member to press the positioning elastic sheet, thereby enabling a capable to be inserted in an insulation seat and electrically connected to the electric conductive terminal.

In comparison with related art, the present invention has advantageous features as follows: the wiring jig and the terminal block provided by the present invention can be operated by one hand, and another hand can process a wiring operation (for example inserting a cable), so an advantage of facilitating the wiring operation is provided; in addition, the operation of the wiring jig provided by the present invention is able to save the conventional jig (used for the insulation seat) and the screwdriver required in the conventional terminal block, so a disadvantage of the terminal block being damaged by the screwdriver can be avoided; moreover, the leverage principle is adopted in the wiring jig provided by the present invention, so the first positioning protrusion formed on the handgrip can be served as a pivot, thereby enabling the hook arm to drive the pull member to press the positioning elastic sheet, so a labor-saving wiring operation is provided; furthermore, when no wiring operation is required, the wiring jig can still be fastened on the terminal block without interfering the normal operation of the terminal block, so the wiring jig is prevented from being lost and able to be directly used after being removed from the terminal block, so advantages of convenient and more practical in used are provided.

DETAILED DESCRIPTION OF THE INVENTION

Preferred embodiments of the present invention will be described with reference to the drawings.

Figure 1:
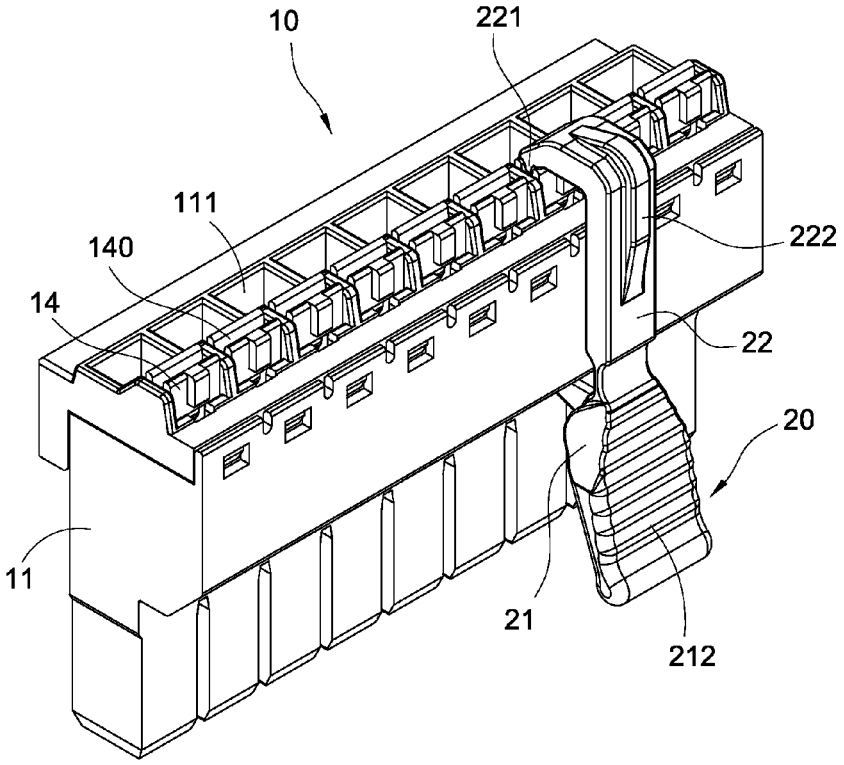
FIG. 1 is a perspective view showing the assembly of a wiring jig and a terminal block according to one preferred embodiment of the present invention.
Figure 2:
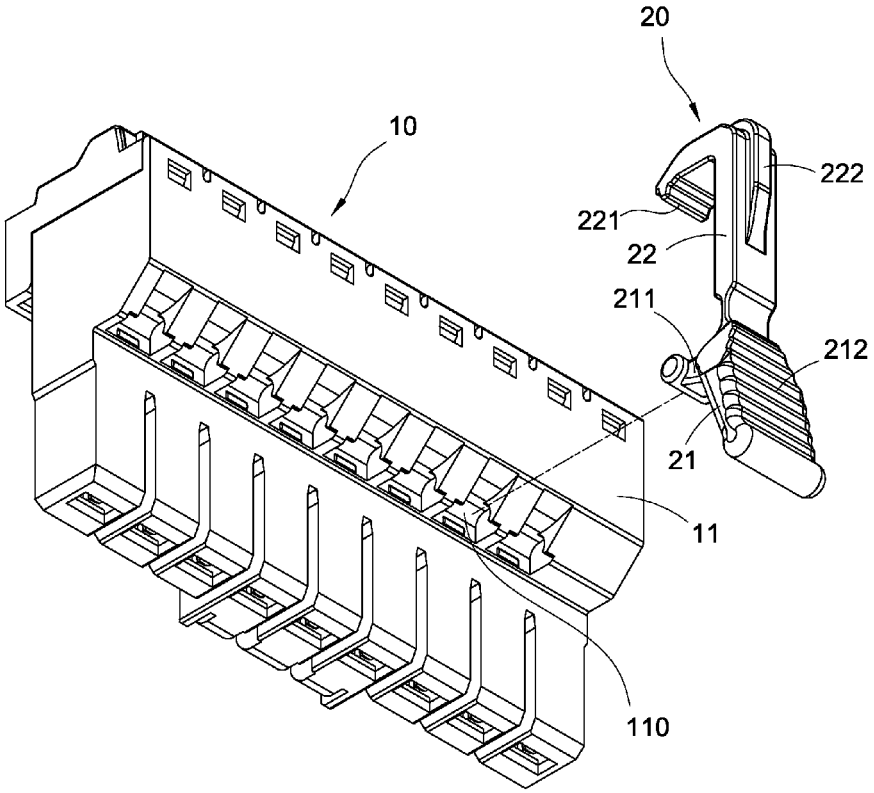
FIG. 2 is a perspective exploded view showing the wiring jig and the terminal block according to one preferred embodiment of the present invention.
Figure 3:
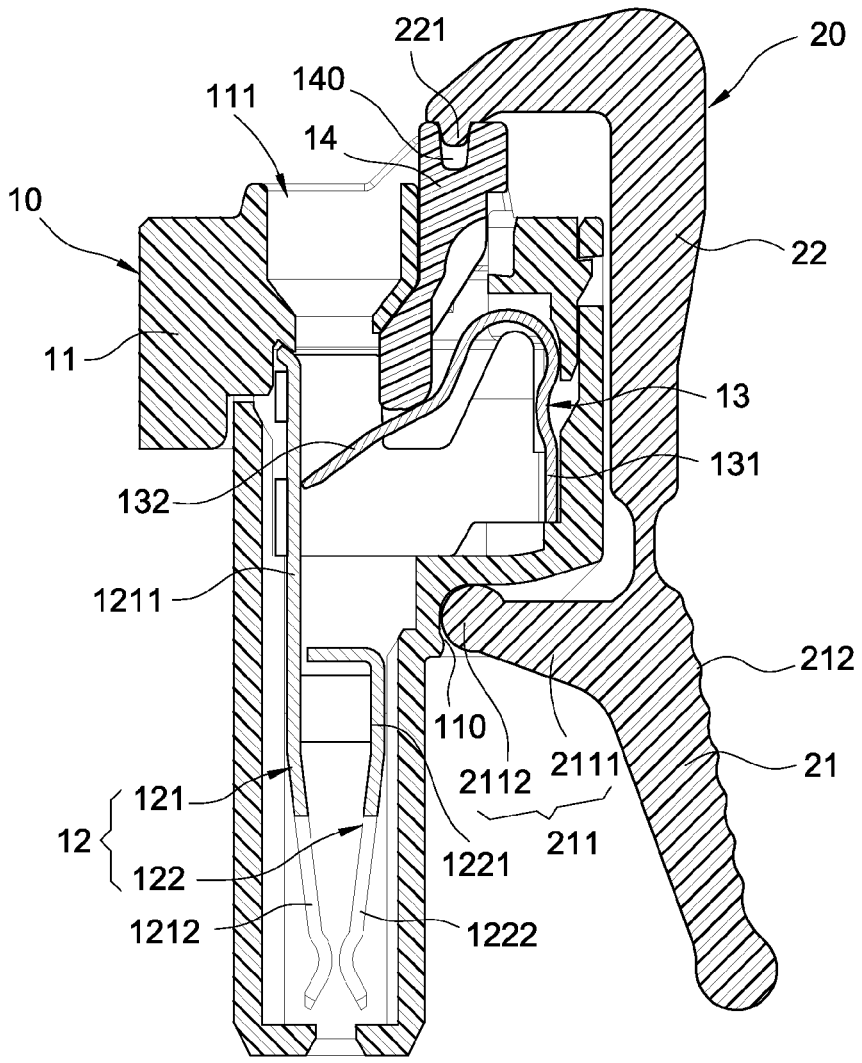
FIG. 3 is a cross sectional view showing the assembly of the wiring jig and the terminal block according to one preferred embodiment of the present invention.

Please refer to FIG. 1 to FIG. 3, wherein are a perspective exploded view, a perspective view and a cross sectional view showing the assembly of the wiring device according to one preferred embodiment of the present invention. The present invention provides a terminal block wiring device, which includes a terminal block (10) and a wiring jig (20). When a wiring operation is desired to be processed, the wiring jig (20) is positioned on the terminal block (10), and an external force is applied to the wiring jig (20) for enabling the wiring jig (20) to assist the process of electrical conduction. On the other hand, if no wiring operation is required, the wiring jig (20) can still be fastened on the terminal block (10) without interfering the normal operation of the terminal block (10), so the wiring jig (20) is able to be prevented from being lost and able to be directly used after being removed from the terminal block (10).

According to one preferred embodiment of the present invention, the terminal block (10) includes an insulation seat (11) and an electric conductive terminal (12), a positioning elastic sheet (13) and a pull member (14) disposed in the insulation seat (11). The outer side of the insulation seat (11) is formed with a positioning recess (110). The positioning elastic sheet (13) is formed with a fasten end (131) connected to the insulation seat (11) and a free end (132) extended above the electric conductive terminal (12). One end of the pull member (14) is formed with an insertion slot (140) exposed outside the insulation seat (11), and the other end thereof is abutted against the free end (132) of the positioning elastic sheet (133); preferably, the cross section of the pull member (14) is formed in a Y-like shape. In addition, the insulation seat (11) includes a plurality of terminal slots (111) arranged at intervals. Each of the terminal slots (111) is respectively installed with the electric conductive terminal (12), the positioning elastic sheet (13) and the pull member (14).

According to this embodiment, the electric conductive terminal (12) is formed with a first clamping guiding sheet (121) substantially extended in parallel along an inner wall of the insulation seat (11) and a second clamping guiding sheet (122) having a part thereof extended towards a transversal direction. The first clamping guiding sheet (121) is formed with a first guiding segment (1211) and a first elastic clamping segment (1212) arranged and fastened in the insulation seat (11). The second clamping guiding sheet (122) is formed with a second guiding segment (1221) transversally extended and a second elastic clamping segment (1222) capable of forming a clamping force relative to the first elastic clamping segment (1212). In addition, the fasten end (131) of the positioning elastic sheet (13) is parallel to the first guiding segment (1211) of the first clamping guiding sheet (121), and the free end (132) of the positioning elastic sheet (13) is hanged at one lateral side of the first clamping guiding sheet (121).

Moreover, the wiring jig (20) includes a handgrip (21) and a hook arm (22) extended from the handgrip (21). One side of the handgrip (21) is formed with a first positioning protrusion (211), and one distal end of the hook arm (22) is formed with a second positioning protrusion (221). The wiring jig (20) is able to be hanged on the terminal block (10) through the first positioning protrusion (211) of the handgrip (21) being positioned in the positioning recess (110) of the insulation seat (11) and the second positioning protrusion (221) of the hook arm (22) being inserted in the insertion slot (140) of the pull member (14).

According to one preferred embodiment of the present invention, the positioning recess (110) of the insulation seat (11) is formed as an arc-shaped surface; the first positioning protrusion (211) of the handgrip (21) further include a connection rod (2111) connected to the handgrip (21) and a circular post (21112) capable of being positioned in the positioning recess (110); however in actual practice, the positioning recess (110) and the first positioning protrusion (211) can be formed at other corresponding locations for being mutually positioned, so what shall be addressed is that the scope of the present invention is not limited to the above-mentioned arrangement.

Preferably, another lateral surface of the handgrip (21) defined opposite to the first positioning protrusion (211) is formed with a plurality of anti-slip ribs (212), the installation of the anti-slip ribs (212) is able to provide a friction force for allowing an external force to be more easily applied to the handgrip (21). In addition, another lateral surface of the hook arm (22) defined opposite to the second positioning protrusion (221) is formed with a supporting rib (222), and the installation of the supporting rib (222) is able to reinforce the structural strength of the hook arm (22).

Figure 4:
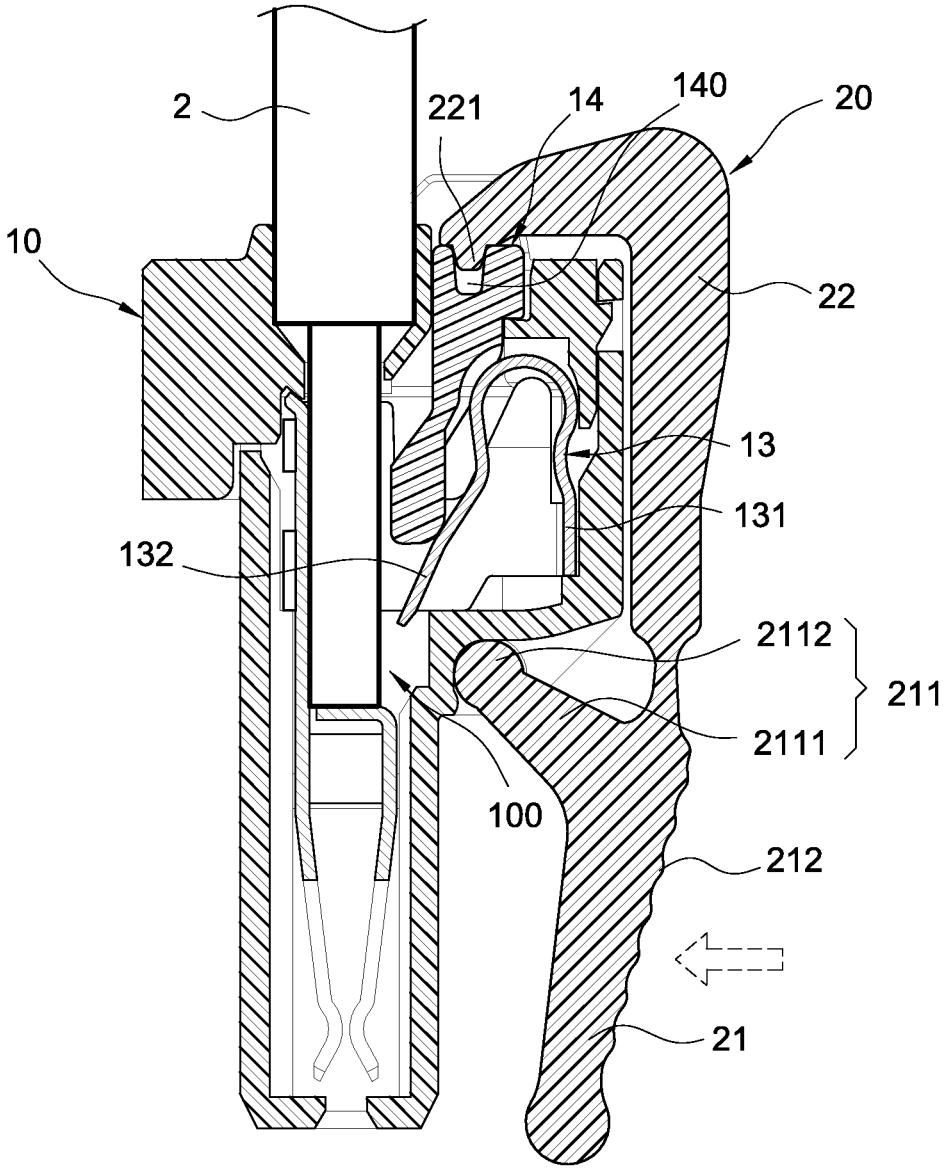
FIG. 4 is a schematic view showing the operating status of the wiring jig according to one preferred embodiment of the present invention.
Figure 5:
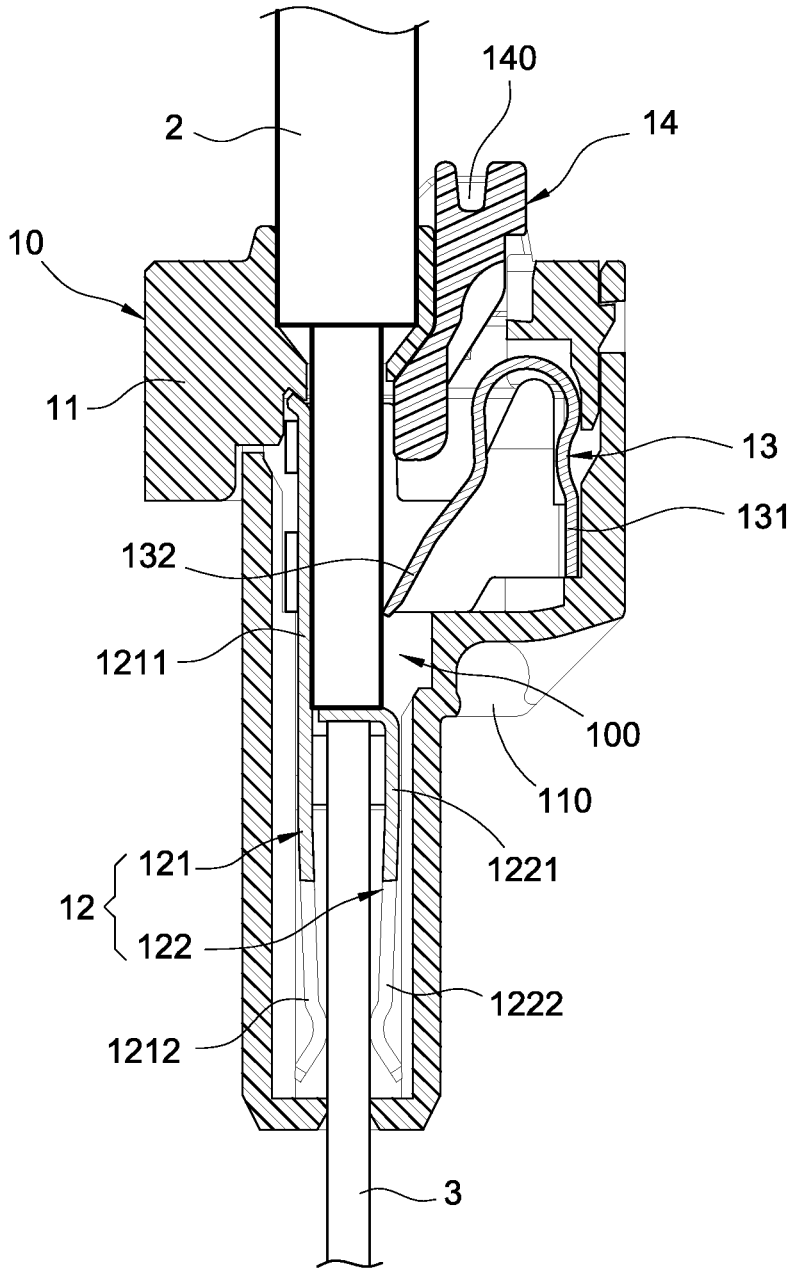
FIG. 5 is a cross sectional view showing a cable being inserted in the terminal block according to one preferred embodiment of the present invention.

Please refer to FIG. 4 and FIG. 5, wherein FIG. 4 is a schematic view showing the operating status of the wiring device according to one preferred embodiment of the present invention; and FIG. 5 is a cross sectional view showing a cable being inserted in the terminal block according to one preferred embodiment of the present invention. When a wiring operation is desired to be processed, firstly the first positioning protrusion (211) of the handgrip (21) is positioned in the positioning recess (110) of the insulation seat (11) and the second positioning protrusion (221) of the hook arm (22) is inserted in the insertion slot (140) of the pull member (14), so the wiring jig (20) is able to be hanged on the terminal block (10).

When being assembled, the handgrip (21) is held by one hand for being applied with an external force so as to press the handgrip (21) towards the insulation seat (11). The first positioning protrusion (211) is served as a pivot for the handgrip (21), so the hook arm (22) is able to drive the pull member (14) to press the positioning elastic sheet (13). The free end (132) of the positioning elastic sheet (13) is pressed by the pull member (14) for being moved away from the electric conductive terminal (12), at this movement an insertion space (100) is formed in the insulation seat (11). Then, a cable (2) is held by another hand for being inserted in the insertion space (100) of the insulation seat (11), thereby allowing the cable (2) to be electrically connected to the electric conductive terminal (12). Accordingly, when the external force is released, the positioning elastic sheet (13) is served to elastically press the cable (2) for enabling the cable (2) to be combined with and positioned in the insulation seat (11).

In addition, a wire (3) can be installed in the terminal block (10), so the cable (2) and the wire (3) can be electrically connected through the terminal block (10). The wire (3) is clamped by the pair of clamping guiding sheets (121, 122), in other words the wire (3) is clamped between the first elastic clamping segment (1212) and the second elastic clamping segment (1222). The wire (3) is enabled to indirectly conduct the cable (2) through the pair of clamping guiding sheets (121, 122), in other words the cable (2) and the wire (3) are electrically connected through the terminal block (10).

Based on what has been disclosed above, the wiring jig (20) provided by the present invention can be used for facilitating the wiring operation for the terminal block (10), thereby achieving effects of fast, convenience and labor saving, and an advantage of allowing the wiring efficiency of the terminal block (10) to be increased is also provided.

Figure 6:
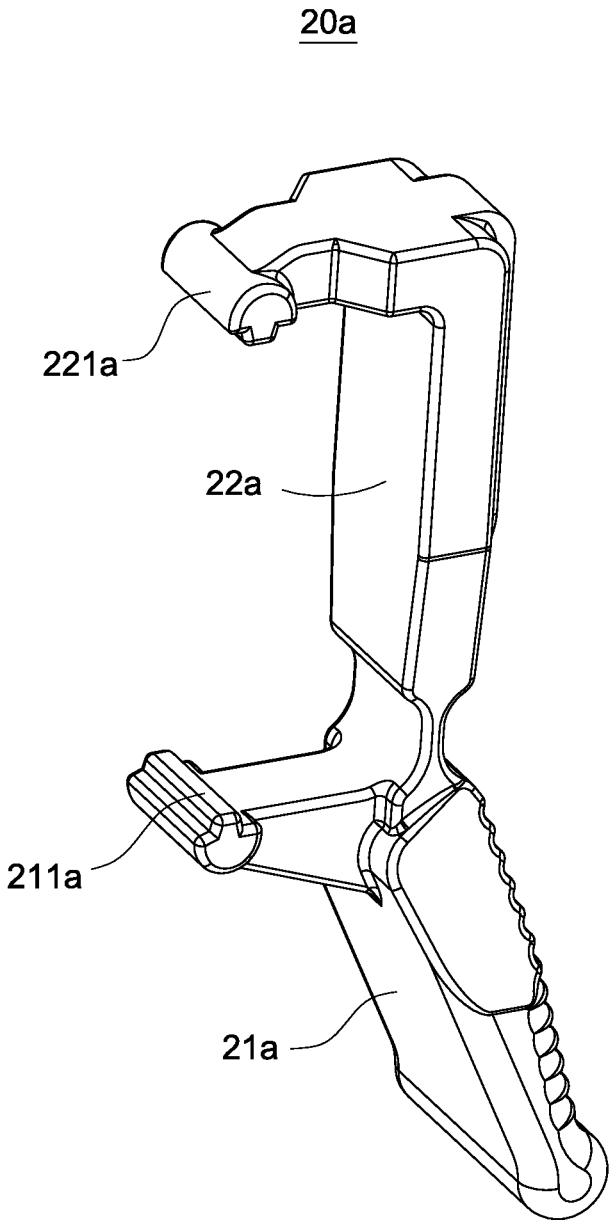
FIG. 6 is a schematic view showing the wiring jig according to another preferred embodiment of the present invention.
Figure 7:
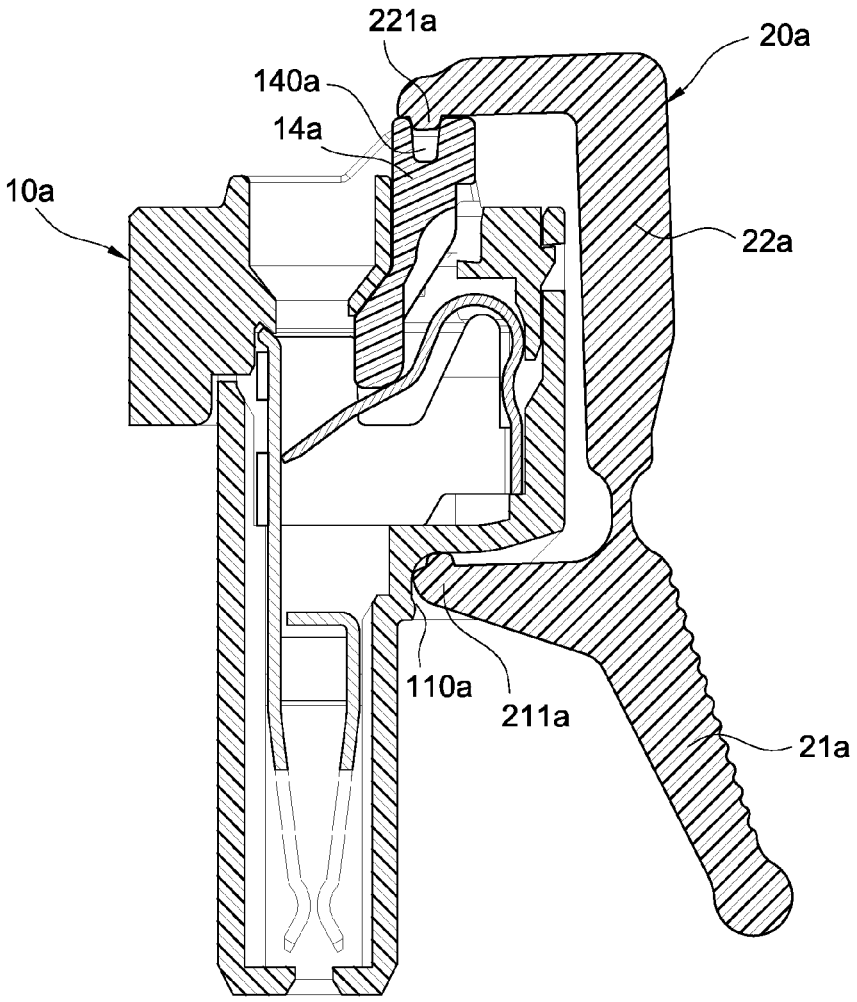
FIG. 7 is a schematic view showing the operating status of the wiring jig according to another preferred embodiment of the present invention.
Figure 8:
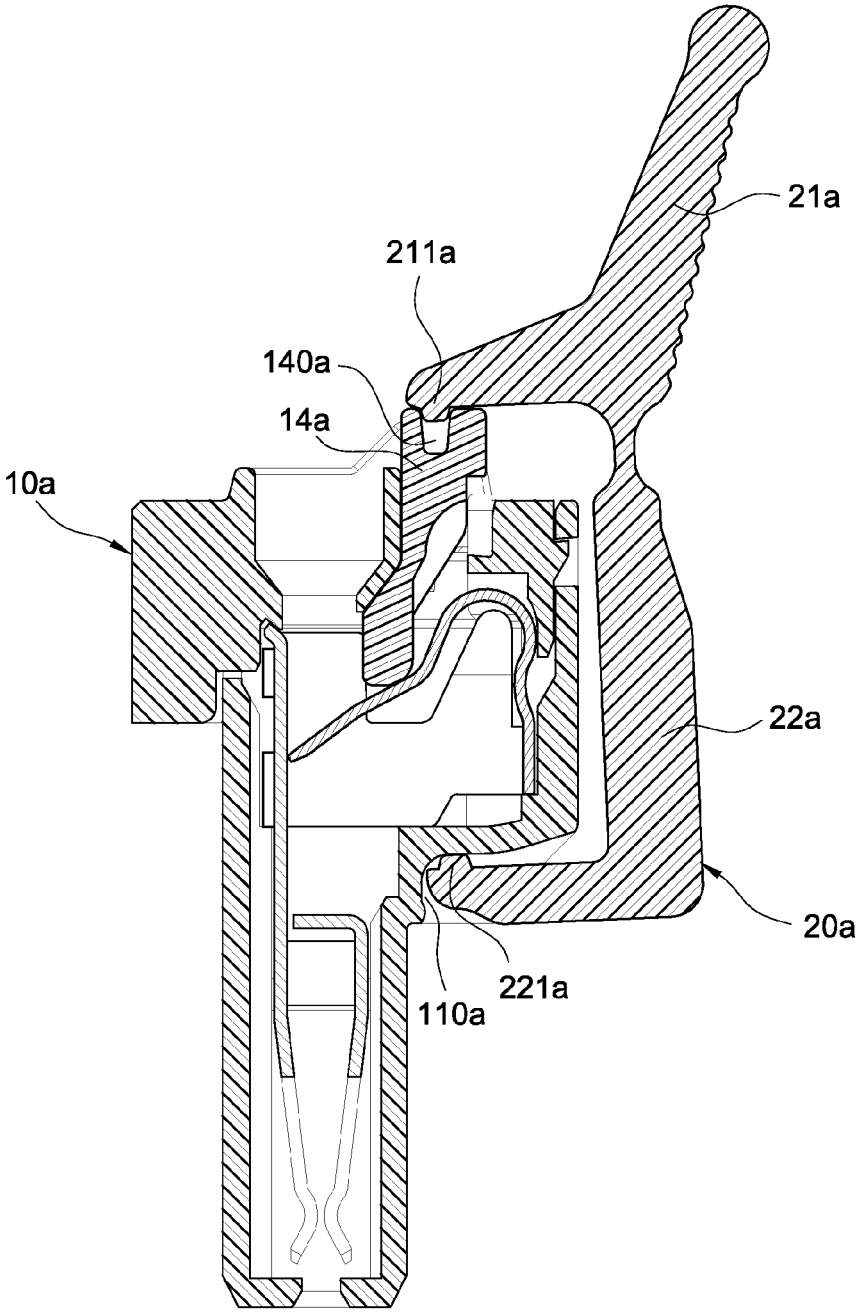
FIG. 8 is another schematic view showing the operating status of the wiring jig according to another preferred embodiment of the present invention.

Please refer from FIG. 6 to FIG. 8, which are a schematic view showing the wiring jig and two schematic views showing the operating status according to another preferred embodiment of the present invention. As shown in FIG. 6, a wiring jig (20*a*) includes a handgrip (21*a*) and a hook arm (22*a*) extended from the handgrip (21*a*). One side of the handgrip (21*a*) is formed with a first positioning protrusion (211*a*), and one distal end of the hook arm (22*a*) is formed with a second positioning protrusion (221*a*). The difference between this embodiment and the previous embodiment is that the cross section of the first positioning protrusion (211*a*) is formed in the same shape as the cross section of the second positioning protrusion (221*a*); preferably, the above-mentioned cross section is formed in a T-like shape.

As shown in FIG. 7, when a wiring operation is desired to be processed, the first positioning protrusion (211*a*) of the handgrip (21*a*) is positioned in a positioning recess (110*a*) of a terminal block (10*a*) and the second positioning protrusion (221*a*) of the hook arm (22*a*) is inserted in an insertion slot (140*a*) of a pull member (14*a*). Accordingly, when an external force is applied to the handgrip (21*a*) and the first positioning protrusion (221*a*) is served as a pivot, the hook arm (22*a*) is able to drive the pull member (14*a*) for processing the operation of combing cable.

As shown in FIG. 8, when the wiring operation is desired to be processed, the wiring jig (20*a*) disclosed in this embodiment is able to allow the second positioning protrusion (221*a*) of the hook arm (22*a*) to be positioned in the positioning recess (110*a*) of the terminal block (10*a*) according to the user's operation habits or the actual needs; on the other hand, the first positioning protrusion (211*a*) of the handgrip (21*a*) is correspondingly inserted in the insertion slot (140*a*) of the pull member (14*a*).

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A terminal block wiring device, capable of facilitating a cable (2) to be electrically connected and including:

a terminal block (10, 10*a*), including an insulation seat (11) and an electric conductive terminal (12), a positioning elastic sheet (13) and a pull member (14) disposed in the insulation seat (11), wherein the outer side of the insulation seat (11) is formed with a positioning recess (110, 110*a*), the positioning elastic sheet (13) is formed with a fasten end (131) connected to the insulation seat (11) and a free end (132) extended above the electric conductive terminal (12), one end of the pull member (14, 14*a*) is formed with an insertion slot (140, 140*a*) exposed outside the insulation seat (11), and the other end thereof is abutted against the free end (132) of the positioning elastic sheet (13); and a wiring jig (20, 20*a*), including a handgrip (21, 21*a*) and a hook arm (22, 22*a*) extended from the handgrip (21, 21*a*), wherein one side of the handgrip (21, 21*a*) is formed with a first positioning protrusion (211, 211*a*), and one distal end of the hook arm (22, 22*a*) is formed with a second positioning protrusion (221, 221*a*);

wherein, the first positioning protrusion (211, 211*a*) is positioned in the positioning recess (110, 110*a*), the second positioning protrusion (221, 221*a*) is inserted in the insertion slot (140, 140*a*), the hook arm (22, 22*a*) is able to drive the pull member (14, 14*a*) to press the positioning elastic sheet (13), the free end (132) is pressed by the pull member (14, 14*a*) for being moved away from the electric conductive terminal (12), and the cable (2) is inserted in the insulation seat (11) and electrically connected to the electric conductive terminal (12), when an external force being released, the positioning elastic sheet (13) is served to elastically press the cable (2) for enabling the cable (2) to be combined with and positioned in the insulation seat (11).

2. The terminal block wiring device according to claim 1, wherein the insulation seat (11) includes a plurality of terminal slots (111) arranged at intervals, and each of the terminal slots (111) is respectively installed with the electric conductive terminal (12), the positioning elastic sheet (13) and the pull member (14, 14*a*).

3. The terminal block wiring device according to claim 1, wherein the electric conductive terminal (12) is formed with a first clamping guiding sheet (121) extended in parallel along an inner wall of the insulation seat (11) and a second clamping guiding sheet (122) having a part thereof extended towards a transversal direction, the first clamping guiding sheet (121) is formed with a first guiding segment (1211) and a first elastic clamping segment (1212) arranged and fastened in the insulation seat (11), the second clamping guiding sheet (122) is formed with a second guiding segment (1221) transversally extended and a second elastic clamping segment (1222) capable of forming a clamping force relative to the first elastic clamping segment (1212).

4. The terminal block wiring device according to claim 3, wherein the fasten end (131) of the positioning elastic sheet (13) is parallel to the first guiding segment (1211), and the free end (132) thereof is hanged at one lateral side of the first clamping guiding sheet (121).

5. The terminal block wiring device according to claim 1, wherein the cross section of the pull member (14, 14*a*) is formed in a Y-like shape.

6. The terminal block wiring device according to claim 1, wherein another lateral surface of the handgrip (21, 21*a*) defined opposite to the first positioning protrusion (211, 211*a*) is formed with a plurality of anti-slip ribs (212), and another lateral surface of the hook arm (22, 22*a*) defined opposite to the second positioning protrusion (221, 221*a*) is formed with a supporting rib (222).

7. The terminal block wiring device according to claim 1, wherein the positioning recess (110, 110*a*) is formed as an arc-shaped surface, and the first positioning protrusion (211, 211*a*) further includes a connection rod (2111) connected to the handgrip (21, 21*a*) and a circular post (2112) capable of being positioned in the positioning recess (110, 110*a*).

8. The terminal block wiring device according to claim 1, wherein the cross section of the first positioning protrusion (211, 211*a*) is formed in the same shape as the cross section of the second positioning protrusion (221, 221*a*).

9. The terminal block wiring device according to claim 1, wherein the cross section of the first positioning protrusion (211, 211*a*) and the cross section of the second positioning protrusion (221, 221*a*) are formed in a T-like shape.

10. A terminal block wiring device, capable of facilitating a cable (2) to be inserted in a terminal block (10, 10*a*), the terminal bock (10, 10*a*) including a positioning elastic sheet (13), an electric conductive terminal (12) and a pull member (14, 14*a*) formed with an insertion slot (140, 140*a*), and a wiring jig (20, 20*a*) including:

a handgrip (21, 21*a*), wherein one side of the handgrip (21, 21*a*) is formed with a first positioning protrusion (211, 211*a*) capable of being positioned on an outer surface of the terminal block (10, 10*a*); and a hook arm (22, 22*a*), extended from the handgrip (21, 21*a*), wherein one distal end of the hook arm (22, 22*a*) is formed with a second positioning protrusion (221, 221*a*) capable of being inserted in the insertion slot (140, 140*a*);

wherein, the hook arm (22, 22*a*) is able to drive the pull member (14, 14*a*) to press the positioning elastic sheet (13), thereby enabling the cable (2) to be inserted in the terminal block (10, 10*a*) and electrically connected to the electric conductive terminal (12).

11. The terminal block wiring device according to claim 10, wherein another lateral surface of the handgrip (21, 21*a*) defined opposite to the first positioning protrusion (211, 211*a*) is formed with a plurality of anti-slip ribs (212), and another lateral surface of the hook arm (22, 22*a*) defined opposite to the second positioning protrusion (221, 221*a*) is formed with a supporting rib (222).

12. The terminal block wiring device according to claim 10, wherein the positioning recess (110, 110*a*) is formed as an arc-shaped surface, and the first positioning protrusion (211, 211*a*) further includes a connection rod (2111) connected to the handgrip (21, 21*a*) and a circular post (2112) capable of being positioned in the positioning recess (110, 110*a*).

13. The terminal block wiring device according to claim 10, wherein the cross section of the first positioning protrusion (211, 211*a*) is formed in the same shape as the cross section of the second positioning protrusion (221, 221*a*).

14. The terminal block wiring device according to claim 13, wherein the cross section of the first positioning protrusion (211, 211*a*) and the cross section of the second positioning protrusion (221, 221*a*) are formed in a T-like shape.

* * * * *